US008152697B2

(12) United States Patent
Wakuda

(10) Patent No.: US 8,152,697 B2
(45) Date of Patent: Apr. 10, 2012

(54) EXERCISE TOOL

(75) Inventor: Shigeki Wakuda, Chofu (JP)

(73) Assignees: Sanriki Kogyo Kabushiki Kaisha, Ota-Ku (JP); Meseko Wakuda, Chofu-Shi (JP)

( * ) Notice: Subject to any disclaimer, the term of this patent is extended or adjusted under 35 U.S.C. 154(b) by 0 days.

(21) Appl. No.: 12/925,140

(22) Filed: Oct. 13, 2010

(65) Prior Publication Data

US 2011/0092346 A1 Apr. 21, 2011

(30) Foreign Application Priority Data

Oct. 21, 2009 (JP) ..... 2009-241983

(51) Int. Cl.
*A63B 21/00* (2006.01)

(52) U.S. Cl. ..... 482/49; 482/126; 482/127

(58) Field of Classification Search ..... 482/49, 482/126, 127, 44, 45
See application file for complete search history.

(56) References Cited

U.S. PATENT DOCUMENTS 3,759,514 A * 9/1973 Cox ..... 482/126
5,954,622 A * 9/1999 Olschansky et al. ..... 482/123

FOREIGN PATENT DOCUMENTS

JP 1967-14417 Y 8/1967
JP 1980-26928 A 2/1980
JP H06-246017 6/1994

* cited by examiner

*Primary Examiner* — Jerome W Donnelly
(74) *Attorney, Agent, or Firm* — Masuvalley & Partners

(57) ABSTRACT

An exercise tool is provided to ensure a good degree of freedom in the direction of movement of the wrists and allows the magnitude of the load applied to the wrists during the exercise to be changed easily so as to enable more effective strengthening of the deep muscles. The exercise tool has a first rod body 10 and a second rod body 20 which are rotatable in opposite directions and also movable away from each other against the biasing force of a coil spring 70. Ring-shaped latch portions 71 and 72 provided at respective ends of the coil spring 70 are removably latched by first and second elastic-member latch bodies 50 and 60, respectively, so that the coil spring 70 can readily be replaced with another coil spring 70 having a different elastic force, thereby facilitating changing the magnitude of the load applied during the wrist exercise.

3 Claims, 8 Drawing Sheets

EXERCISE TOOL

This application claims priority under 35 U.S.C. §119 from Japanese patent application Serial No. 2009-241983, filed Oct. 21, 2009, entitled "EXERCISE TOOL", which is incorporated herein by reference in its entirety.

TECHNICAL FIELD

The present invention relates to an exercise tool and apparatus. More specifically it relates to an exercise tool suitable, e.g., for a wrist rotation exercise.

BACKGROUND OF THE INVENTION

A human body is covered with a large number of layers of muscles from the location near the center of the body close to the bones. The muscles in the relatively deep location are called "inner (or deep) muscles", while the muscles near the body surface are called "outer (or superficial) muscles".

The deep muscles are responsible primarily for meticulously adjusting the postures and keeping the joints in the right positions. The superficial muscles are responsible for producing a large force.

In order to maintain the activity of the deep and superficial muscles, an appropriate amount of training is necessary. With the deep muscles and the superficial muscles having different functions, the training required therefore differs from each other.

Specifically, while the superficial muscles require training using heavy weight and high load such as bench press or squat exercise, the deep muscles do not require the training using such heavy weight and high load.

This is because the deep muscles are originally for doing supplementary actions; they are not intended to create a large force like the large and thick superficial muscles.

As a tool for use in training the deep muscles, Japanese Patent Application Laid-Open No. 6-246017 proposes a wrist twisting exercise tool having two coil springs wound in opposite directions from each other. Each coil spring has one end fixedly secured to a rotation transmission axis. Another end of each coil spring is fixedly secured to a corresponding one of two continually supported outer tubes via a corresponding bearing plate, after the coils are wound to maintain a repulsive force. A shaft retaining pin is provided at each end of the rotation transmission shaft, and the retaining pin and the corresponding end of the spring constitute a rotation and reverse-rotation limiting unit.

According to the above-described wrist twisting exercise tool of Japanese Patent Application Laid-Open No. 6-246017, the coil springs are attached inside the tubes while the repulsive force is being maintained. When a user holds the two outer tubes, to do a rotation exercise, with the right and left hands respectively, the tool works so as to have repulsive resistance from the beginning of rotation, so that the load can be applied effectively to the wrists and other sites.

With this wrist twisting exercise tool, however, the load is applied from the coil spring only in the case where the outer tube is rotated in the direction opposing the wound direction of the coil spring. This means that the direction in rotating each of the left and right hands is limited to one direction. Specifically, for example in the case where a user rotates his/her right hand away from his/her body and his/her left hand toward his/her body, the coil spring load acts. On the other hand, if the user rotates the right hand toward his/her body and the left hand away from his/her body, then the coil spring load would not act. The user cannot alternately rotate the left and right hands frontward and backward while holding the outer tubes, resulting in a poor degree of freedom in the direction of movement.

Furthermore, the tool is configured such that the coil spring load acts only when the outer tubes are rotated. This restricts the type of exercise only to the wrist rotation exercise, again resulting in a poor degree of freedom in the direction of movement.

Still further, the coil springs are attached inside the outer tubes, hindering replacement thereof. Therefore, the magnitude of the load cannot be changed easily.

If a sufficient degree of freedom in the direction of movement of the wrists cannot be maintained or if the magnitude of the load in the wrist exercise cannot be changed easily, as in the above-described case, the deep muscles cannot be strengthened effectively.

SUMMARY OF THE INVENTION

In view of the foregoing, an object of the present invention is to provide an exercise tool which guarantees a sufficient degree of freedom in the direction of movement of the wrists and facilitates changing the magnitude of the load applied during the wrist exercise, thereby enabling more effective strengthening of the deep muscles.

An exercise tool according to the present invention includes: a first rod body; a second rod body configured to support part of the first rod body in a rotatable and slidable manner; a first elastic-member latch body provided on an outside of the first rod body; a second elastic-member latch body provided on an outside of the second rod body; and an elastic member having one end removably latched by the first elastic-member latch body and another end removably latched by the second elastic-member latch body; wherein the first rod body and the second rod body are configured to be rotatable in opposite directions from each other and movable away from each other against a biasing force applied by the elastic member.

Further, the exercise tool may be configured such that the first rod body is made up of a tubular portion with a larger outside diameter and a tubular portion with a smaller outside diameter, the tubular portions being formed into one piece, that the second rod body is made up of a tube body having an outside diameter, the second rod body having a hollow tube body allowing the tubular portion with the smaller outside diameter to be movably inserted therein, that the tubular portion with the smaller outside diameter is movably inserted in the second rod body and the tubular portion with the larger outside diameter is exposed to the outside, that the first elastic-member latch body is provided on an outer periphery of the tubular portion with the larger outside diameter, and that the second elastic-member latch body is provided on an outer periphery of the tube body.

Still further, the second rod body is provided with a blocking member, a stopper member having a shock absorbing function is attached to an end surface of the stopper member or an end surface of the tubular portion with the smaller outside diameter of the first rod body, a gap is provided between an end surface of the tubular portion with the larger outside diameter of the first rod body and an end surface of the second rod body, and the exercise tool may be configured such that the first rod body has a free end provided with a first grip, and that the second rod body has a free end provided with a second grip.

With the exercise tool of the present invention, the first rod body and the second rod body are configured to be rotatable in opposite directions from each other and movable away from each other against the biasing force applied by the elastic member. This ensures a sufficient degree of freedom in the direction of movement of the wrists. Furthermore, the elastic member has one end and the other end removably latched by the first and second elastic-member latch bodies, respectively. This allows the elastic member to be readily replaced with another one having a different elastic force, thereby facilitating changing the magnitude of the load applied during the wrist exercise.

According to the exercise tool of the present invention, a sufficient degree of freedom in the direction of movement of the wrists is guaranteed and the magnitude of the load applied to the wrists during the exercise can be changed with ease, whereby the deep muscles can be strengthened more effectively.

DESCRIPTION OF THE PREFERRED EMBODIMENTS

Embodiments of the present invention will be described hereinafter with reference to the accompanying drawings, in which preferred exemplary embodiments of the invention are shown. The ensuing description is not intended to limit the scope, applicability or configuration of the disclosure. Rather, the ensuing description of the preferred exemplary embodiments will provide those skilled in the art with an enabling description for implementing preferred exemplary embodiments of the disclosure. It should be noted that this invention may be embodied in different forms without departing from the spirit and scope of the invention as set forth in the appended claims.

(First Embodiment)

Figure 1:
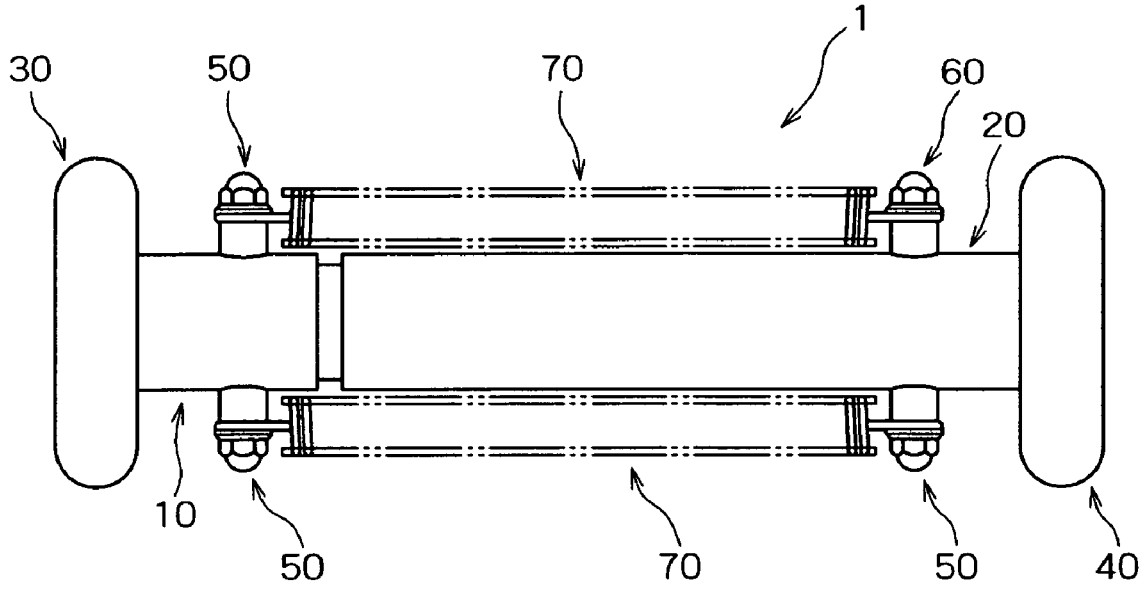
FIG. 1 is a front view of an exercise tool according to a first embodiment of the present invention.

Hereinafter, preferred embodiments of the present invention will be described in detail. FIG. 1 is a front view of a first embodiment of the exercise tool according to the present invention, and FIG. 2 is a partially cut-away view of the exercise tool shown in FIG. 1.

Firstly, as shown in FIG. 1, an exercise tool 1 includes a first rod body 10, a second rod body 20, a first grip 30, a second grip 40, a first elastic-member latch body 50, a second elastic-member latch body 60, and coil springs 70.

According to the exercise tool 1 shown in FIG. 1, the details of which will be described later, the first rod body 10 and the second rod body 20 are configured to be rotatable in opposite directions from each other against the biasing force of the coil springs 70. Furthermore, the first rod body 10 and the second rod body 20 are configured to be movable away from each other against the biasing force of the coil springs 70 which are elastic members. Each coil spring 70 is configured to be replaceable with another coil spring having a different elastic force.

Figure 2:
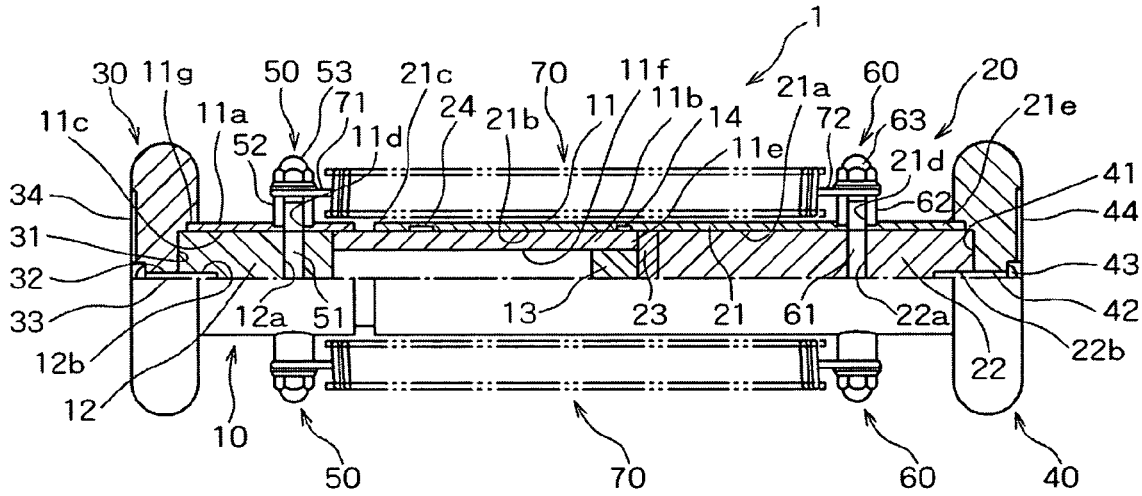
FIG. 2 is a partially cut-away view of the exercise tool shown in FIG. 1.

More specifically, as shown in FIG. 2, the first rod body 10 has a hollow tube body 11. This tube body 11 is formed, e.g., of aluminum alloy die-cast. It is noted that the tube body 11 may be formed of stainless steel, plastic, wood, or the like, besides the aluminum alloy die-cast, as long as a certain degree of stiffness is guaranteed.

The tube body 11 is made up of a tubular portion 11*a* with a larger outside diameter and a tubular portion 1l*b* with a smaller outside diameter, the tubular portions being formed into one piece. The tubular portion 1l*b* with the smaller outside diameter is movably inserted into the second rod body 20, while the tubular portion 11*a* with the larger outside diameter is exposed to the outside.

The tubular portion 11*a* has a hollow portion 11*c* in which a blocking member 12 is filled. The blocking member 12 may be formed, e.g., of the aluminum alloy described above, or not limited thereto, it may be formed of stainless steel, plastic, wood, or the like. The first elastic-member latch body 50 is provided so as to protrude from an outer periphery of the first rod body 10. The tubular portion 11*a* and the blocking member 12 have communication holes 11*d* and 12*a* formed therethrough, into which a threaded rod 51 of the first elastic-member latch body 50 is inserted.

The threaded rod 51 has its respective ends provided with threads. A nut 53 is screwed onto each of the threads via a collar 52, so that the threaded rod 51 is secured to the first rod body 10.

Each coil spring 70 has one end provided with a ring-shaped latch portion 71. When screwing the nut 53, the latch portion 71 may be sandwiched between the nut 53 and the collar 52, so that the one end of the coil spring 70 is latched by the first elastic-member latch body 50. Thus, when the coil spring 70 is to be replaced with another coil spring 70 with a different elastic force, the nut 53 may be loosened and removed from the threaded rod 51 and the latch portion 71 at the one end of the coil spring 70 may be replaced with a corresponding one of the new coil spring 70, which facilitates replacement of the coil spring 70. It is noted that the one end of the coil spring 70 may of course be in a hook shape, instead of the ring shape.

At a distal end 11*e* of the tubular portion 11*b* (opposite to its proximal end where the first grip 30 is attached, as will be described later), a stopper member 13 of rubber or the like having a shock absorbing function is filled in a hollow portion 11*f* so as to block the hollow portion 11*f*. When the first rod body 10 and the second rod body 20 are returned swiftly by the biasing force of the coil springs 70, the stopper member 13 can absorb impact on a blocking member 22, which will be described later, of the second rod body 20.

Furthermore, a ring member 14 is provided on an outer periphery of the tubular portion 11*b* at its distal end 11*e*. This ring member 14, together with a ring member 24 provided at the tube body 21 of the second rod body 20, which will be described later, maintains a predetermined gap between the tubular portion 11*b* and the inner side of the tube body 21, thereby preventing the tubular portion 11*b* from rattling inside the tube body 21.

Each of the ring member 14 and the ring member 24, as described later, is preferably a member having a small coefficient of friction. Forming each of the ring member 14 and the ring member 24 as a member having such a small friction coefficient ensures that the first rod body 10 and the second rod body 20 move smoothly when they rotate in opposite directions from each other or move away from each other against the biasing force of the coil springs 70.

While the hollow portions 11*c* and 11*f* provided respectively in the tubular portions 11*a* and 11*b* as described above can reduce the weight of the first rod body 10, the hollow portions 11*c* and 11*f* do not necessarily have to be provided if weight reduction is unnecessary.

The tubular portion 11*b* has a proximal end 11*g* (constituting the free end of the first rod body 10) to which the first grip 30 described above is attached. Specifically, the first grip 30 has a recess 31 formed to match the shapes of the outer edges of the blocking member 12 and the proximal end 11*g* of the tubular portion 11*b*, and the recess 31 is mated with the proximal end 11*g* of the tubular portion 11*b*.

At the center of the first grip 30, a communication hole 32 is formed which communicates with a screw mounting hole 12*b* provided in the blocking member 12. When a screw 33 is inserted into the communication hole 32 and screwed into the screw mounting hole 12*b*, the first grip 30 is fixedly secured to the proximal end 11*g* of the tubular portion 11*b*. On the surface of the first grip 30, a label 34, for example, is affixed so as to conceal the communication hole 32 and the screw 33 inserted into the communication hole 32.

Here, the first grip 30 is in a disk shape, although the first grip 30 may of course be in any shape other than the disk shape as long as it can be held easily by the hand. The first grip 30 may be formed of stainless steel, plastic, wood, or the like, not restricted to the aluminum alloy die-cast.

On the other hand, the second rod body 20 has a hollow tube body 21. This tube body 21 is formed, e.g., of aluminum alloy die-cast, similarly as described above. It is noted that the tube body 21 may also be formed of stainless steel, plastic, wood, or the like, besides the aluminum alloy die-cast, as long as it provides a certain degree of stiffness.

The tube body 21 has a hollow portion 21*a* in which a blocking member 22 is filled. The blocking member 22 has a length corresponding to an approximately half the length of the hollow portion 21*a* of the tube body 21, so that a clearance hole 21*b* is formed in the left-side part in the figure into which the tubular portion 11*b* of the first rod body 10 described above is inserted in a freely slidable and rotatable manner.

Further, a stopper member 23 such as rubber having a shock absorbing function is attached to an end surface of the blocking member 22. When the first rod body 10 and the second rod body 20 are returned swiftly by the biasing force of the coil springs 70, the stopper member 23 can absorb the impact applied on the blocking member 22 of the second rod body 20, similarly as described above.

Still further, a ring member 24 is attached to an inner periphery of the tube body 21 at its distal end 21*c* (opposite to its proximal end where the second grip 40 is attached, as will be described later). This ring member 24, together with the ring member 14 of the tubular portion 11*b*, prevents the tubular portion 11*b* from rattling inside the tube body 21, as described above.

It is noted that a gap is secured between the distal end 21*c* of the tube body 21 of the second rod body 20 and the tubular portion 11*a* having the larger outside inside diameter of the first rod body 10. Although this gap does not necessarily have to be provided, it can prevent a user's fingers from being accidentally caught there between when the user repeats the motion of pulling the first rod body 10 and the second rod body 20 away from each other against the biasing force of the coil springs 70.

Furthermore, the second elastic-member latch body 60 is provided so as to protrude from the outer periphery of the second rod body 20, and the tube body 21 and the blocking member 22 have communication holes 21*d* and 22*a* formed therethrough, into which a threaded rod 61 of the second elastic-member latch body 60 is inserted.

The threaded rod 61 has its respective ends provided with threads. A nut 63 is screwed onto each of the threads via a collar 62, so that the threaded rod 61 is secured to the second rod body 20.

Each coil spring 70 has the other end provided with a ring-shaped latch portion 72. When screwing the nut 63, the latch portion 72 may be sandwiched between the nut 63 and the collar 62, so that the other end of the coil spring 70 is latched by the second elastic-member latch body 60. Thus, when the coil spring 70 is to be replaced with another coil spring 70 with a different elastic force, the nut 63 may be loosened and removed from the threaded rod 61 and the latch portion 72 at the other end of the coil spring 70 may be replaced with a corresponding one of the new coil spring 70, similarly as described above, whereby the coil spring 70 can be replaced with ease. It is noted that the other end of the coil spring 70 may of course be in a hook shape, instead of the ring shape.

Here, it is configured such that the exercise tool 1 is provided with two coil springs 70, with their respective ends latched by the corresponding ends of the threaded rods 51 and 61 of the first and second elastic-member latch bodies 50 and 60. Alternatively, a single coil spring 70 may be attached to the first and second elastic-member latch bodies 50 and 60.

Still alternatively, another first elastic-member latch body 50 and another second elastic-member latch body 60 may be additionally provided so that three or four coil springs 70 can be attached. Specifically, another threaded rod 51 may be provided to extend approximately orthogonal to the existing threaded rod 51, and another threaded rod 61 may be provided to extend approximately orthogonal to the existing threaded rod 61, in which case at most four coil springs 70 can be attached to the exercise tool 1. It is also possible to replace the coil spring 70 with another type of elastic member such as rubber.

The tube body 21 has a proximal end 21*e* to which the second grip 40 described above is attached. Specifically, the second grip 40 has a recess 41 formed to match the shapes of the outer edges of the blocking member 22 and the proximal end 21*e* of the tube body 21, and the recess 41 is mated with the proximal end 21*e* of the tube body 21.

At the center of the second grip 40, a communication hole 42 is formed which communicates with a screw mounting hole 22*b* provided in the blocking member 22. When a screw 43 is inserted into the communication hole 42 and screwed into the screw mounting hole 22*b*, the second grip 40 is fixedly secured to the proximal end 21*e* of the tube body 21. On the surface of the second grip 40, a label 44, for example, is affixed so as to conceal the communication hole 42 and the screw 43 inserted into the communication hole 42.

Here, likewise the first grip 30, the second grip 40 is in a disk shape, although the second grip 40 may of course be in any shape other than the disk shape as long as it can be held easily by the hand. The second grip 40 may be formed of stainless steel, plastic, wood, or the like, not restricted to the aluminum alloy die-cast, again likewise the first grip 30.

Figure 3:
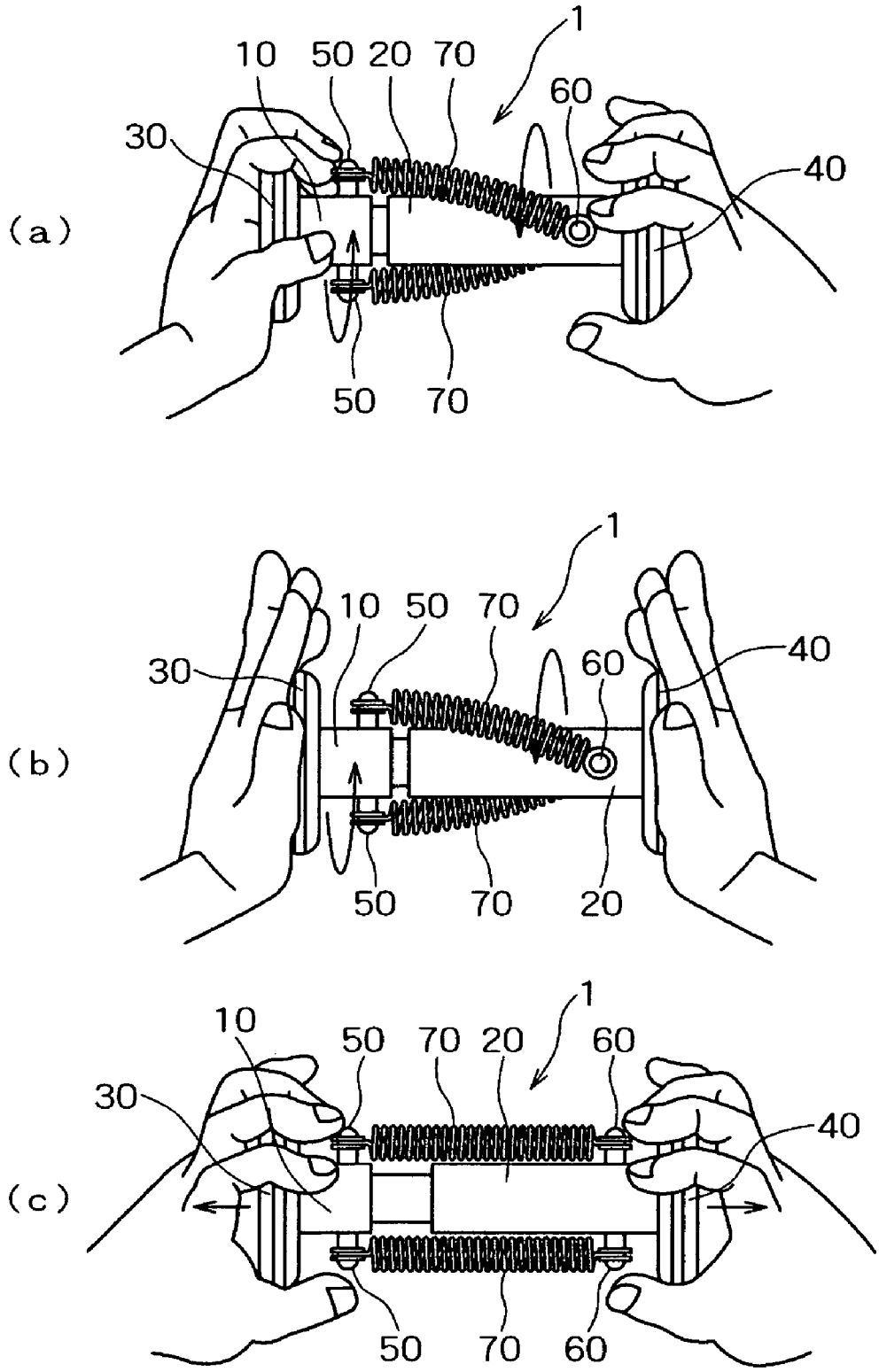
FIGS. 3A, 3B, and 3C illustrate how to use the exercise tool shown in FIGS. 1-2.
Figure 4:
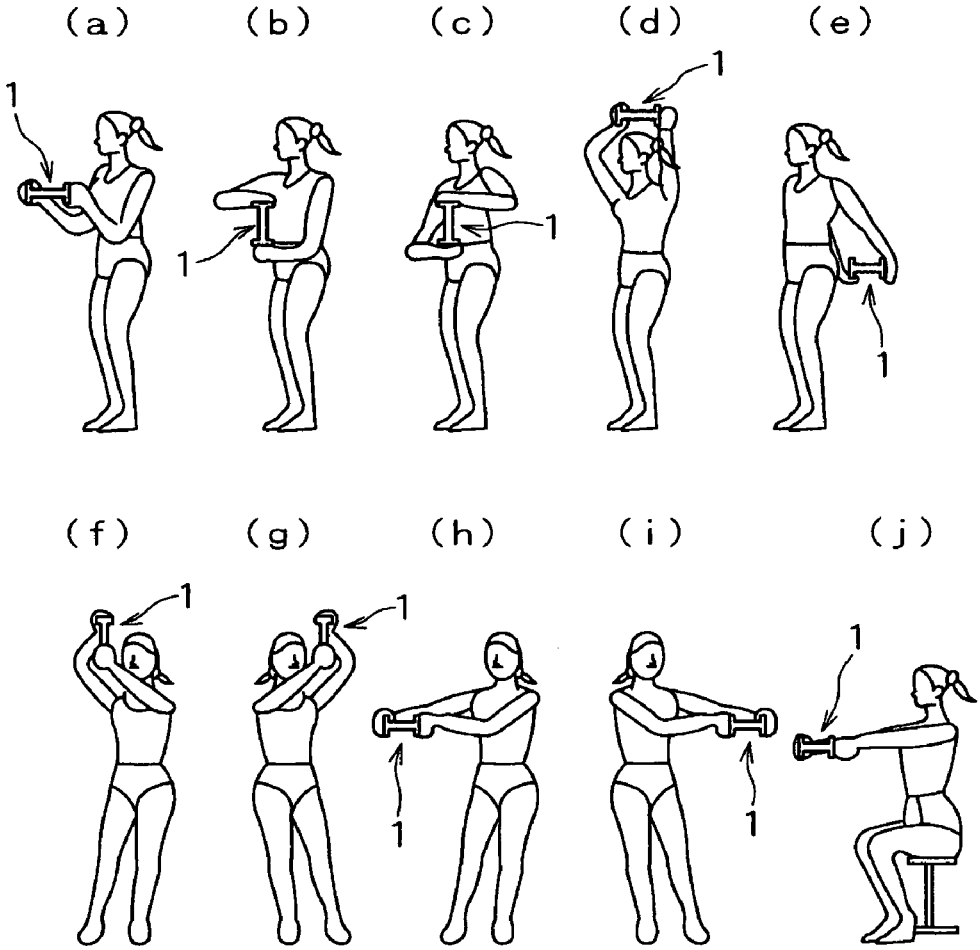
FIG. 4 shows various exercise positions that can be taken when using the exercise tool shown in FIGS. 1-2.

Hereinafter, a way of using the exercise tool 1 described above will be described with reference to FIGS. 3A, 3B, 3C, and 4. FIGS. 3A and 3B illustrate the case of performing the wrist rotation exercise, and FIG. 3C illustrates the case of performing the wrist pulling exercise. FIG. 4 illustrates various exercise positions that can be taken when using the exercise tool 1.

Firstly, as shown in FIG. 3A, the first grip 30 and the second grip 40 are held by the left and right hands, respectively. While the case of holding the first grip 30 with the left hand and the second grip 40 with the right hand is illustrated, the direction of the exercise tool 1 may be reversed (so that the first grip 30 is located to the right and the second grip 40 is located to the left in the figure) in which case the first grip 30 may be held by the right hand and the second grip 40 may be held by the left hand.

In this state, when the user causes the first grip 30 and the second grip 40 to rotate in opposite directions from each other, the first rod body 10 and the second rod body 20 come to rotate in opposite directions with the tubular portion 11*b* of the first rod body 10 being movably inserted in the clearance hole 21*b* of the tube body 21 of the second rod body 20. At this time, with the ring member 14 provided on the outer periphery at the distal end 11*e* of the tubular portion 11*b* of the first rod body 10 and the ring member 24 provided at the tube body 21 of the second rod body 20, a predetermined gap is maintained between the tubular portion 11*b* and the inner side of the tube body 21, which can prevent the tubular portion 11*b* from rattling inside the tube body 21, thereby ensuring smooth rotation of the first rod body 10 and the second rod body 20 in the opposite directions.

As the first rod body 10 and the second rod body 20 are rotated in the opposite directions from each other, the positions of the first elastic-member latch body 50 and the second elastic-member latch body 60 are changed, so that the coil springs 70 are pulled. As the coil springs 70 are pulled, the rotations of the first rod body 10 and the second rod body 20 create a load, which is applied onto the wrists and others.

As the positions of the first elastic-member latch body 50 and the second elastic-member latch body 60 are changed, the pulled coil springs 70 come to be wound around the outer peripheral surface of the second rod body 20 in a spiral manner. As the coil springs 70 are spirally wound around the outer peripheral surface of the second rod body 20, the load created by the rotations of the first rod body 10 and the second rod body 20 become large, even if the angles of rotation of the first rod body 10 and the second rod body 20 are small, whereby the wrist rotation exercise can be performed more effectively.

As the wrist rotation exercise is performed more effectively, it is possible to effectively strengthen the deep muscles for not only the wrists, but also the fingers, the elbows, the shoulder joints, and around the shoulder blades.

Furthermore, as shown in FIG. 3B, the user may cause the first grip 30 and the second grip 40 to rotate in opposite directions from each other, as described above, in the state where the user presses the palms of the left and right hands against the first grip 30 and the second grip 40, respectively.

In this case, the wrist rotation exercise is performed with the fingers spread apart, allowing the load to be more effectively applied to the deep muscles for not only the wrists, but also the fingers, the elbows, the shoulder joints, and around the shoulder blades, resulting in more effective strengthening of the deep muscles.

Still further, as shown in FIG. 3C, the first grip 30 and the second grip 40 may be pulled away from each other in the state where the first grip 30 is held with the left hand and the second grip 40 is held with the right hand, for example. At this time, as the distance between the first elastic-member latch body 50 and the second elastic-member latch body 60 increases, the coil springs 70 are pulled, resulting in an appropriate load applied to the left and right wrists and others via the first grip 30 and the second grip 40.

In performing the exercises illustrated in FIGS. 3A to 3C, the nuts 53 and 63 of the first and second elastic-member latch bodies 50 and 60 may be loosened and removed from the threaded rods 51 and 61, respectively, to replace the coil spring 70 with another coil spring 70 with a different elastic force, as described above. This allows the exercise for the deep muscles to be performed effectively in accordance with individual differences, for example.

Furthermore, the exercises illustrated in FIGS. 3A to 3C may be performed in various exercise positions as illustrated in FIG. 4 to strengthen the deep muscles more effectively. Specifically, the exercises may be performed with the exercise tool 1 being held horizontally in front of the chest, as illustrated in FIG. 4(*a*).

Alternatively, the exercises may be performed with the exercise tool 1 being held upright with the left hand at the bottom and the right hand at the top, as illustrated in FIG. 4(*b*), or with the right hand at the bottom and the left hand at the top, as illustrated in FIG. 4(*c*).

Furthermore, the exercises may be performed with the exercise tool 1 being held horizontally on top of the head, as illustrated in FIG. 4(*d*), or with the exercise tool 1 being held horizontally at the back, as illustrated in FIG. 4(*e*). Still further, the exercises may be performed with the exercise tool 1 being held upright above the right shoulder, as illustrated in FIG. 4(*f*).

Alternatively, the exercises may be performed with the exercise tool 1 being held upright above the left shoulder, as illustrated in FIG. 4(*g*). Furthermore, the exercises may be performed with the exercise tool 1 being held horizontally near the right side, as illustrated in FIG. 4(*h*), or near the left side, as illustrated in FIG. 4(*i*). Still further, the exercises may be performed, in the seated state, with the exercise tool 1 being held horizontally in front of the chest, as illustrated in FIG. 4(*j*).

As described above, according to the first embodiment of the present invention, the first rod body 10 and the second rod body 20 are configured to be rotatable in opposite directions from each other and also movable away from each other against the biasing force of the coil springs 70 which are elastic members, whereby a sufficient degree of freedom in the direction of movement of the wrists is guaranteed. Furthermore, the ring-shaped latch portion 71 at one end of each coil spring 70 and the ring-shaped latch portion 72 at the other end of the coil spring 70 are configured to be removably latched by the first and second elastic-member latch bodies 50 and 60, respectively, to facilitate replacement of the coil spring 70 with another one having a different elastic force. As a result, the load applied during the exercise of the wrists can be changed easily, whereby the deep muscles can be strengthened more effectively.

Furthermore, in the first embodiment, the first grip 30 is provided at the free end of the first rod body 10, and the second grip 40 is provided at the free end of the second rod body 20. This not only facilitates holding of the first grip 30 and the second grip 40, but also can apply the load by the biasing force of the coil springs 70 more effectively to the wrists and others.

(Second Embodiment)

Figure 5:
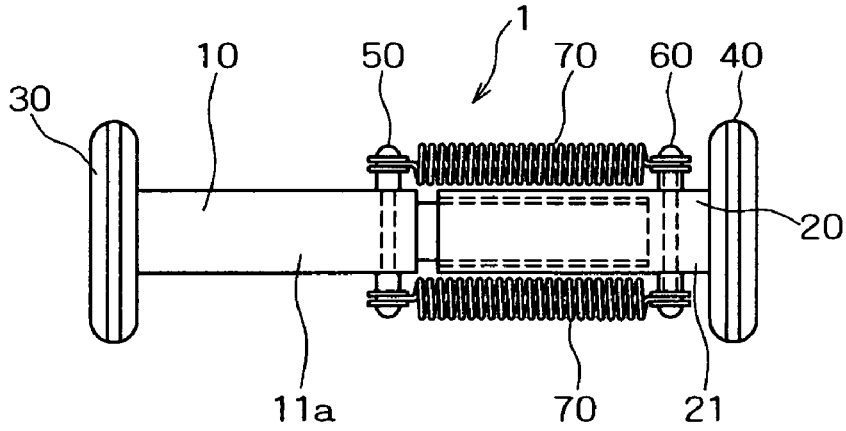
FIG. 5 shows an exercise tool according to a second embodiment of the present invention modified in configuration from the exercise tool shown in FIGS. 1-2.
Figure 6:
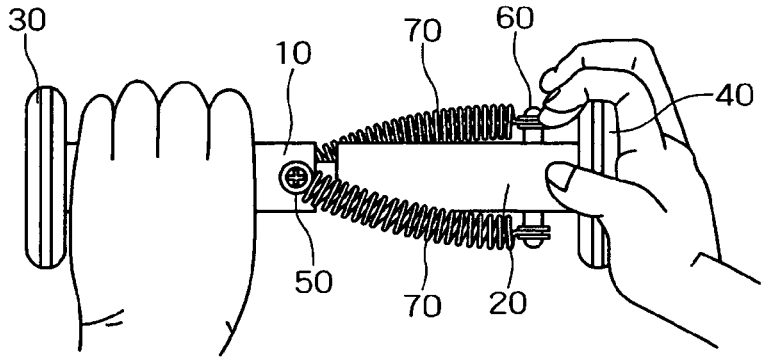
FIG. 6 illustrates how to use the exercise tool shown in FIG. 5.

With reference to FIGS. 5-6, a second embodiment of the present invention will be described in detail. FIG. 5 shows an exercise tool according to the second embodiment in which the configuration of the exercise tool 1 shown in FIGS. 1-2 has been modified. FIG. 6 illustrates how to use the exercise tool 1 shown in FIG. 5. It should be noted that in the figures, as will be described further below, the parts common to those shown in FIGS. 1-2 are denoted by the same reference characters, and description thereof will not be repeated as appropriate.

Firstly, the exercise tool 1 of the second embodiment differs from that of the first embodiment in that, as seen from FIG. 5, the tubular portion 11*a* with the larger outside diameter of the first rod body 10 in the exercise tool 1 is formed longer than that in the exercise tool 1 shown in FIGS. 1 and 2. Otherwise, the configuration of the exercise tool 1 of the second embodiment is approximately the same as that of the first embodiment, as shown in FIGS. 1-2. Here, the tubular portion 11*a* may have a length sufficient for a user to grip the tubular portion 1l*a* with an entire palm of the hand.

With this exercise tool 1, for example in the case where the first grip 30 is located to the left as shown in FIG. 6, the tubular portion 11*a* of the first rod body 10 may be gripped with the left hand and the second grip 40 may be held with the right hand. In this state, the left hand may be rotated back and forth, with the right hand kept still.

In the case of rotating the right hand back and forth, the first grip 30 may be located to the right, and the tubular portion 11*a* of the first rod body 10 may be gripped with the right hand and the second grip 40 may be held with the left hand. In this state, opposite from the above case, the right hand may be rotated back and forth, with the left hand kept still.

As described above, according to the second embodiment of the present invention, the tubular portion 11*a* of the first rod body 10 is configured to be gripped with the left or right hand. As a result, in addition to the above-described exercises, an exercise of rotating the palm or back of the left or right hand backward and forward can further be performed.

(Third Embodiment)

Figure 7:
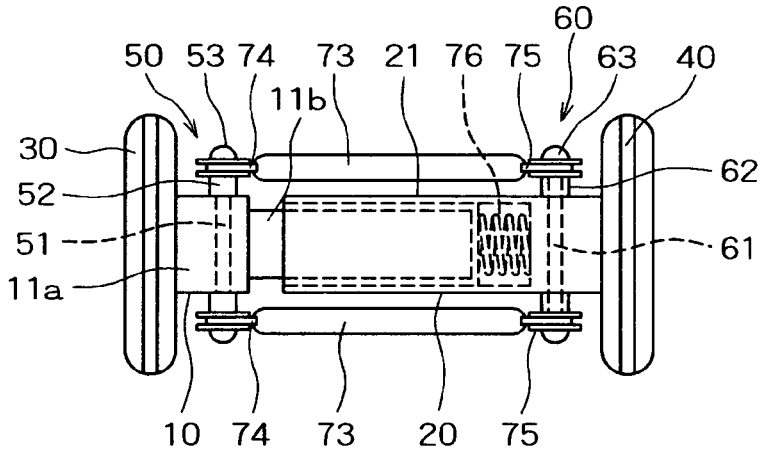
FIG. 7 shows an exercise tool according to a third embodiment of the present invention modified in configuration from the exercise tool shown in FIGS. 1-2.
Figure 8:
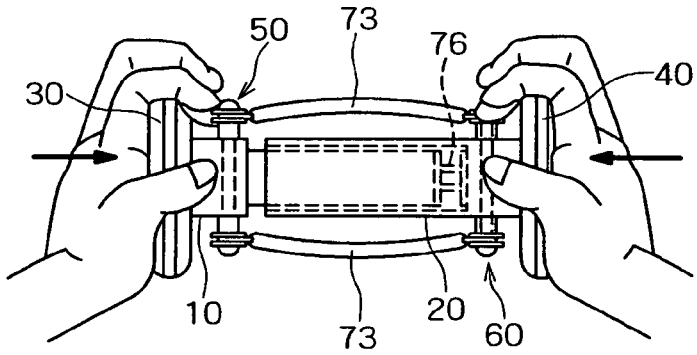
FIG. 8 illustrates how to use the exercise tool shown in FIG. 7.

Referring next to FIGS. 7-8, a third embodiment of the present invention will be described in detail. FIG. 7 shows an exercise tool according to the third embodiment in which the configuration of the exercise tool 1 shown in FIGS. 1-2 has been modified. FIG. 8 illustrates how to use the exercise tool 1 shown in FIG. 7.

Firstly, the exercise tool 1 of the third embodiment differs from that of the first embodiment in that, as seen from FIG. 7, the coil springs 70 have been replaced with elastic members 73 such as rubber, and that a coil spring 76 has been provided in the tube body 21 of the second rod body 20. Otherwise, the configuration of the exercise tool 1 of the third embodiment is approximately the same as that of the exercise tool 1 shown in FIGS. 1-2.

Each elastic member 73 shown in the figure has ring-shaped latch portions 74 and 75 at its respective ends. It is noted that the latch portions 74 and 75 may each be in a hook shape, not restricted to the ring shape. The latch portion 74 of the elastic member 73 is sandwiched between the nut 53 and the collar 52 of the first elastic-member latch body 50 and the latch portion 75 of the elastic member 73 is sandwiched between the nut 63 and the collar 62 of the second elastic-member latch body 60, as described above, so that the respective ends of the elastic member 73 are latched by the first and second elastic-member latch bodies 50 and 60.

Accordingly, when the elastic member 73 is to be replaced with another elastic member 73 with a different elastic force, the nuts 53 and 63 may be loosened and removed from the threaded rods 51 and 61, respectively, so as to remove the latch portions 74 and 75 at the respective ends of the elastic member 73 and insert corresponding ones of the new elastic member 73, similarly as described above. This ensures easy replacement of the elastic member 73.

Furthermore, with the exercise tool 1 of the present embodiment, when the first grip 30 and the second grip 40 are held with the respective hands and pushed against each other with the palms, as shown in FIG. 8, a load is applied by the coil spring 76 provided in the tube body 21 of the second rod body 20.

As the elastic member 73 is used in place of the coil spring 70, the exercises illustrated in FIGS. 3A, 3B, and 3C can naturally be performed as well.

As described above, according to the third embodiment of the present invention, the coil spring 76 is arranged inside the tube body 21 of the second rod body 20, which enables, in addition to the exercises described above, the exercise of holding the first grip 30 and the second grip 40 with the respective hands and pushing the first grip 30 and the second grip 40 against each other with the palms of the hands.

Fourth Embodiment

Figure 9:
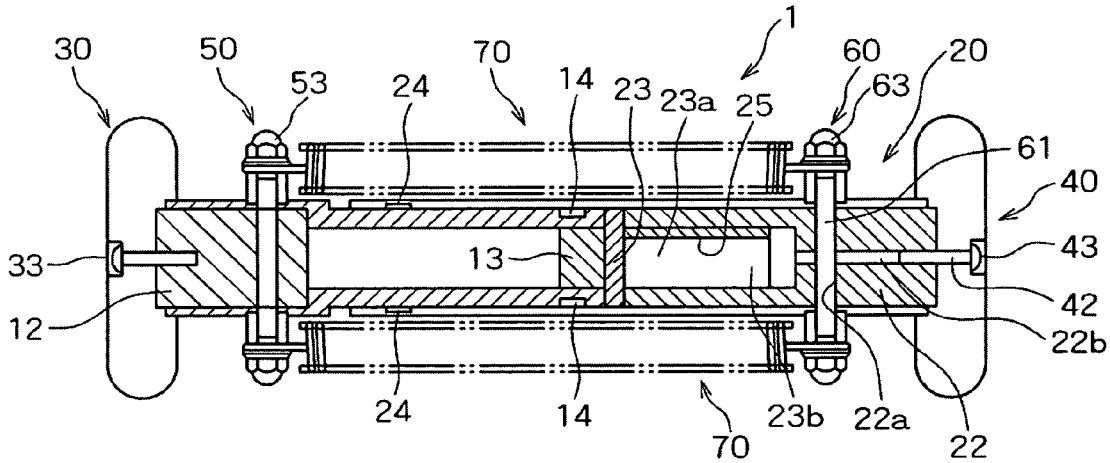
FIG. 9 is a cross-sectional view of an exercise tool according to a fourth embodiment of the present invention modified in internal configuration of the first and second rod bodies from the exercise tool shown in FIGS. 1-2.
Figure 10:
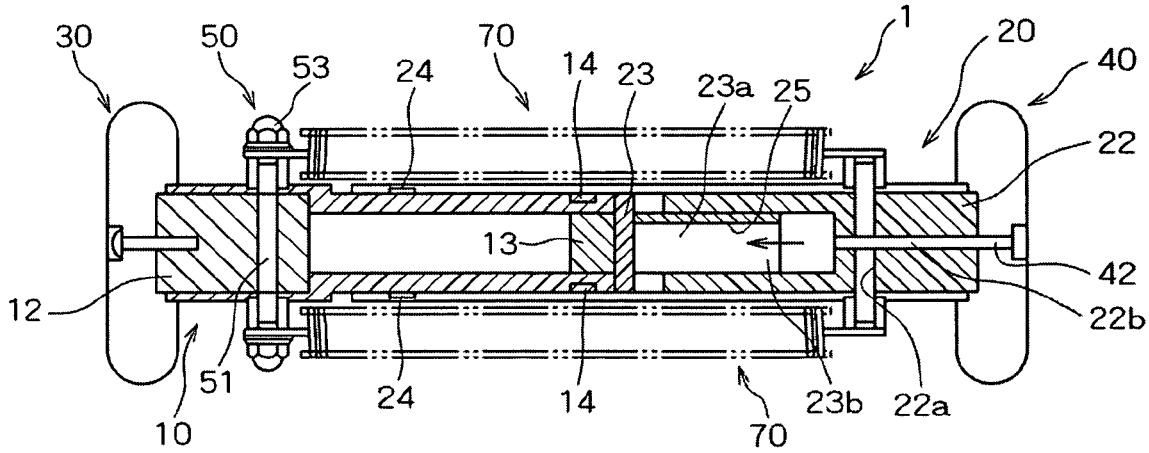
FIG. 10 illustrates the case of changing the elastic force of the coil springs in the exercise tool shown in FIG. 9.

With reference to FIGS. 9-10, a fourth embodiment of the present invention will be described in detail. FIG. 9 is a cross-sectional view of an exercise tool 1, according to the fourth embodiment of the present invention, in which the inner structures of the first and second rod bodies of the exercise tool 1, shown in FIGS. 1-2, have been modified. FIG. 10 illustrates the case of changing the elastic force of the coil springs in the exercise tool 1 shown in FIG. 9.

Firstly, as shown in FIG. 9, the exercise tool 1 of the fourth embodiment differs from that of the first embodiment shown in FIGS. 1-2 in the following points. The blocking member 22 arranged in the tube body 21 of the second rod body 20 is provided with a threaded concave portion 25 having threads on an inner surface thereof. The stopper member 23 is provided with a threaded shaft 23*a* having threads on an outer periphery thereof, and the threaded shaft 23*a* is screwed into the threaded concave portion 25. Furthermore, the screw mounting hole 22*b* that is in communication with the communication hole 42 of the second grip 40 is formed to reach the threaded concave portion 25. Otherwise, the configuration of the exercise tool 1 of the fourth embodiment is approximately the same as that of the exercise tool 1 shown in FIGS. 1-2, for example.

With the exercise tool 1 having such a structure, when the screw 43 is removed from the second grip 40, as shown in FIG. 10, the second grip 40 can be removed from the second rod body 20. At this time, the screw mounting hole 22*b* that is provided in the blocking member 22 and in communication with the threaded concave portion 25 is exposed to the outside. Here, if slots or a slot matching the end shape of a cross slot screwdriver or a straight slot screwdriver is provided at an end 23*b* of the threaded shaft 23*a* attached to the stopper member 23, the cross slot or straight slot screwdriver may be inserted from the screw mounting hole 22*b* so as to turn the threaded shaft 23*a* clockwise or anticlockwise.

For example if it is configured such that when the threaded shaft 23*a* is turned clockwise, it moves in a direction shown by an arrow in FIG. 10 while mating with the threads provided on the threaded concave portion 25, then the amount of feed of the threaded shaft 23*a* in the arrow direction may be adjusted so as to readily change the elastic force of the coil springs 70 without the need of replacing the same.

As described above, according to the fourth embodiment, the threaded shaft 23*a* screwed into the threaded concave portion 25 may be turned using a cross slot or straight slot screwdriver so as to adjust the amount of feed of the threaded shaft 23*a* in the arrow direction. Accordingly, the elastic force of the coil springs 70 can readily be changed without the need of replacing the same.

(Fifth Embodiment)

Figure 11:
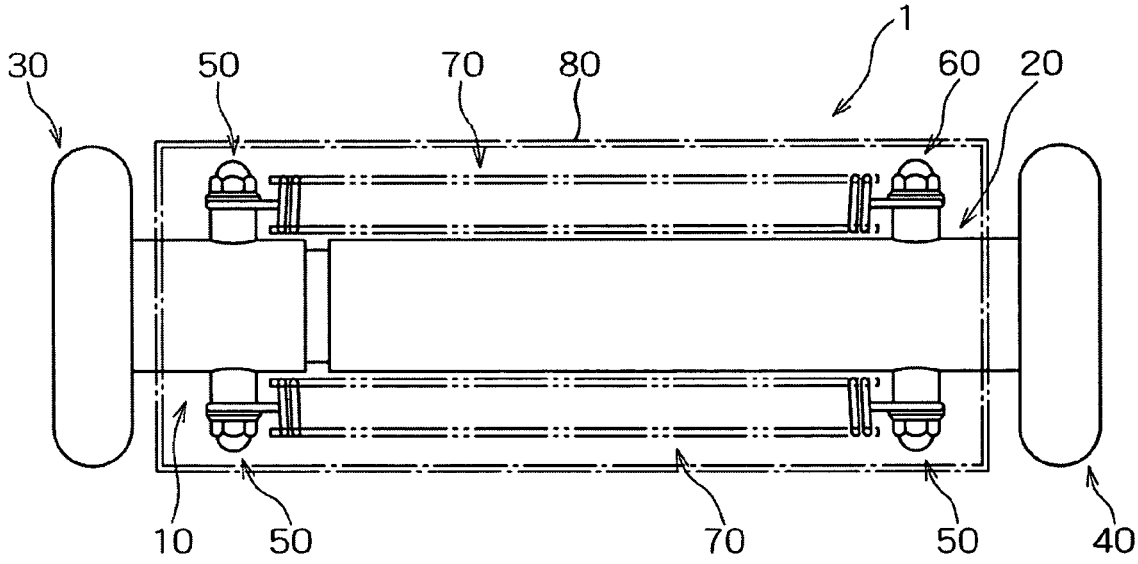
FIG. 11 shows the case where the exercise tool shown in FIGS. 1-2 is provided with a cover.

Referring next to FIG. 11, a fifth embodiment of present invention will be described in detail. FIG. 11 shows the case where a cover is provided for the exercise tool 1 shown in FIGS. 1-2.

As shown in FIG. 11, it may be configured such that the first rod body 10, the second rod body 20, and the coil springs 70 are covered with a cover 80. With the first rod body 10, the second rod body 20, and the coil springs 70 being covered by the cover 80, in the case where the rotation exercise or the like is being performed, the cover 80 prevents the coil springs 70 from coming into contact with the surroundings. This prevents a user's fingers from being accidentally caught by the coil spring 70 being pulled, resulting in an increased safety.

Here, the cover 80 may be formed of transparent plastic. The cover 80 may be provided with a temporary joint member allowing the cover 80 to be secured to the first rod body 10 or the second rod body 20. Providing the cover 80 with the temporary joint member prevents the cover 80 from easily coming off during the use of the exercise tool 1.

The cover 80 may be transparent or nontransparent. If it is transparent, the user can see from the outside how the first rod body 10, the second rod body 20, and the coil springs 70 work.

As described above, according to the fifth embodiment of present invention, at least the circumference of the coil springs 70 is separated by the cover 80, which prevents the user's fingers from being accidentally caught by the coil spring 70 being pulled, whereby safety is enhanced.

It should be noted that in each of the above-described embodiments, the exercise tool 1 may be configured such that a sound is produced from the first rod body 10 and/or the second rod body 20 in accordance with the rotation exercise or the pulling exercise. To this end, a mechanism element whose internal pressure changes in accordance with the rotation exercise or pulling exercise and a member in which a sound is produced by the mechanism element may be provided inside the first rod body 10 and/or the second rod body 20.

In this case, producing a sound once for each rotating motion or each pulling motion can make the rotation or pulling exercise dynamic, or the user can use the sound to count the number of times of motions made.

Furthermore, a luminous body such as an LED may be provided on the outer periphery of the first rod body 10 and/or the second rod body 20, and a simple power-generating circuit made up of a coil and a magnet may be provided in the first rod body 10 and the second rod body 20, so as to cause the luminous body such as the LED to emit light by the power-generating circuit in accordance with the rotation exercise or pulling exercise.

In this embodiment, when the luminous body such as the LED is made to emit light once for each rotating motion or each pulling motion, the rotation or pulling exercise becomes dynamic, or the user can use the light to count the number of times of motions made, similarly as described above.

While the principles of the disclosure have been described above in connection with specific apparatuses and methods, it is to be clearly understood that this description is made only by way of example and not as limitation on the scope of the invention.

What is claimed is:

1. An exercise tool comprising:

a first rod body made up of a tubular portion with a larger outside diameter and a tubular portion with a smaller outside diameter, the tubular portions being formed into one piece;

a second rod body configured to support the tubular portion with the smaller outside diameter of the first rod body in a rotatable and slidable manner, the second rod body having a hollow tube body;

a first elastic member latch body provided on an outside of the first rod body;

a second elastic member latch body provided on an outside of the second rod body; and an elastic member having one end removably latched by the first elastic member latch body and another end removably latched by the second elastic member latch body, wherein:

the second rod body is provided with a blocking member, a stopper member having a shock absorbing function is attached to an end surface of the stopper member or an end surface of the tubular portion with the smaller outside diameter of the first rod body, a gap is provided between an end surface of the tubular portion with the larger outside diameter of the first rod body and an end surface of the second rod body, and the first rod body and the second rod body are configured to be rotatable in opposite directions from each other and movable away from each other against a biasing force applied by the elastic member.

2. The exercise tool according to claim 1, wherein:

the second rod body is made up of a tube body having an inside diameter allowing the tubular portion with the smaller outside diameter of the first rod body to be movably inserted in the second rod body while the tubular portion with the larger outside diameter of the first rod body is exposed to the outside of the second rod body, the first elastic-member latch body is provided on an outer periphery of the tubular portion with the larger outside diameter of the first rod body, and the second elastic-member latch body is provided on an outer periphery of the tube body.

3. The exercise tool according to claim 1 or 2, wherein:

the first rod body has a free end provided with a first grip, and the second rod body has a free end provided with a second grip.

* * * * *

UNITED STATES PATENT AND TRADEMARK OFFICE

CERTIFICATE OF CORRECTION

PATENT NO. : 8,152,697 B2
APPLICATION NO. : 12/925140
DATED : April 10, 2012
INVENTOR(S) : Shigeki Wakuda It is certified that error appears in the above-identified patent and that said Letters Patent is hereby corrected as shown below:

Title Page;

In field (73) on the first page of the patent, one Assignee's name is spelled incorrectly. The correct spelling is: --Masako Wakuda--

Signed and Sealed this
Nineteenth Day of June, 2012

David J. Kappos

David J. Kappos
*Director of the United States Patent and Trademark Office*